United States Patent [19]

Cartabbia

[11] Patent Number: 4,499,677

[45] Date of Patent: Feb. 19, 1985

[54] MACHINE FOR IRONING COLLARS AND CUFFS

[75] Inventor: Giovanni Cartabbia, Palazzolo Sull'Oglio, Italy

[73] Assignee: Bordogna O. & C., Macpi S.p.A., Palazzolo Sull'Oglio, Italy

[21] Appl. No.: 446,361

[22] Filed: Dec. 2, 1982

[30] Foreign Application Priority Data

Dec. 21, 1981 [IT] Italy ..... 25723 A/81

[51] Int. Cl.[3] ..... D06F 71/22

[52] U.S. Cl. ..... 38/28

[58] Field of Search ..... 223/70, 73; 38/28, 30–35, 38/42, 43

[56] References Cited

U.S. PATENT DOCUMENTS

| | | | |
|---|---|---|---|
| 1,042,752 | 10/1912 | Bartholomew | 38/34 |
| 1,054,269 | 2/1913 | Bartholomew | 38/34 |
| 1,151,239 | 8/1915 | Bartholomew | 38/35 |

*Primary Examiner*—Werner H. Schroeder
*Assistant Examiner*—Andrew M. Falik
*Attorney, Agent, or Firm*—Bucknam and Archer

[57] ABSTRACT

The machine comprises a fixed dummy for receiving an article of clothing having a collar and lapels, and an upper mold supported by a support structure such as to be pivotable about a horizontal axis adjacent the dummy. The upper mold has a configuration substantially matching that of the dummy and a lug-shaped front portion extending downwardly. The support structure is vertically displaceable by a fluid-operated cylinder between a position in which the upper mold is spaced from the dummy and a position in which the upper mold contacts the dummy and is pressed against it. In this position the ironing of the collar of the article of clothing is carried out, while the ironing of the lapels occurs by additionally pivoting the upper mold about the horizontal axis and pressing the lug-shaped front portion thereof against the lapels.

3 Claims, 6 Drawing Figures

MACHINE FOR IRONING COLLARS AND CUFFS

BACKGROUND OF THE INVENTION

The present invention relates to a machine for ironing collars or cuffs or lapels on articles of clothing.

As it is known, in the working cycle in the clothing trade there is included an ironing step provided for giving to the produced article of clothing its definitive aspect.

That ironing step is carried out by ironing machines having a structure depending on the particular article of clothing to be ironed. In particular, for ironing articles of clothing provided with collars and cuffs or lapels there are usually employed ironing machines including a press and an interexchangeable manikin or dummy assembly.

The mentioned ironing machines substantially comprise a manikin or positive mold, over which the article of clothing to be ironed is fitted, and a negative or upper mold effective to be strongly pressed against the article of clothing while the latter is subjected to steam jets.

The conventional ironing machine provided with press and manikin, on the other hand, are designed for exclusively carrying out a proper ironing of the collars.

In order to carry out the ironing of collars and cuffs or lapels, in fact, it is presently necessary to use two separate machines or provide the collar ironing machines with additional side structures provided for being suitably moved, jointly to the manikin assembly, with reciprocating, rotatory and translatory movements.

That need, on the other hand, causes presently available machines for ironing collars and cuffs or lapels to have a rather complicated and cumbersome structure, thereby they are frequently subjected to operation malfunctions.

Moreover, in those same known ironing machines it is possible to note a rather low efficiency, because of the time elapsing between the collar and cuff or lapels ironing steps, due to the rather large displacements of the movable structures.

SUMMARY OF THE INVENTION

Accordingly, the task of the present invention is to overcome the hereinabove mentioned drawbacks by providing a machine for ironing both collars and cuffs or lapels, which is effective to operate with a single negative or upper mold, effective to cooperate with a fixed manikin or dummy.

Within that task, it is a primary object of the present invention to provide an ironing machine for ironing collars and cuffs or lapels which affords the possibility of gradually adjusting the ironing pressure on said cuffs or lapels.

Yet another object of the present invention is to provide an ironing machine for ironing collars and cuffs or lapels which is of high operation efficiency, thereby reducing the time between the ironing of collars and the ironing of cuffs or lapels.

Yet another object of the present invention is to provide a machine for ironing collars and cuffs or lapels which is effective to allow for the two lapels of an article of clothing to be ironed contemporaneously in such a way as to leave, at the lower portion thereof, a rather broadly curved fold.

Yet another object of the present invention is to provide a machine for ironing collars and cuffs or lapels which is structurally simple and very reliable in operation.

According to one aspect of the present invention, the above task and objects as well as yet other objects which will become more apparent hereinafter, are achieved by a machine for ironing collars and cuffs or lapels, characterized in that it comprises a fixed manikin or taylor's dummy and an upper mold, movable along a vertical axis and so constructed as to be superimposable also on the front portion of said fixed manikin, said upper mold being effective to assume two different positions with respect to said fixed manikin, by pivotal movement about a horizontal axis, parallel to the lying vertical plane of said fixed manikin.

Advantageously the rotation of said upper mold is induced by a pneumatic cylinder, acting against the biassing action of resilient means.

BRIEF DESCRIPTION OF THE DRAWINGS

Further characteristics and advantages of the machine for ironing collars and cuffs or lapels according to the present invention, will become more apparent from the following detailed description of a preferred embodiment thereof, being illustrated, by way of an indicatice but not limitative example, in the accompanying drawings, where.

DESCRIPTION OF THE PREFERRED EMBODIMENT

Figure 2:
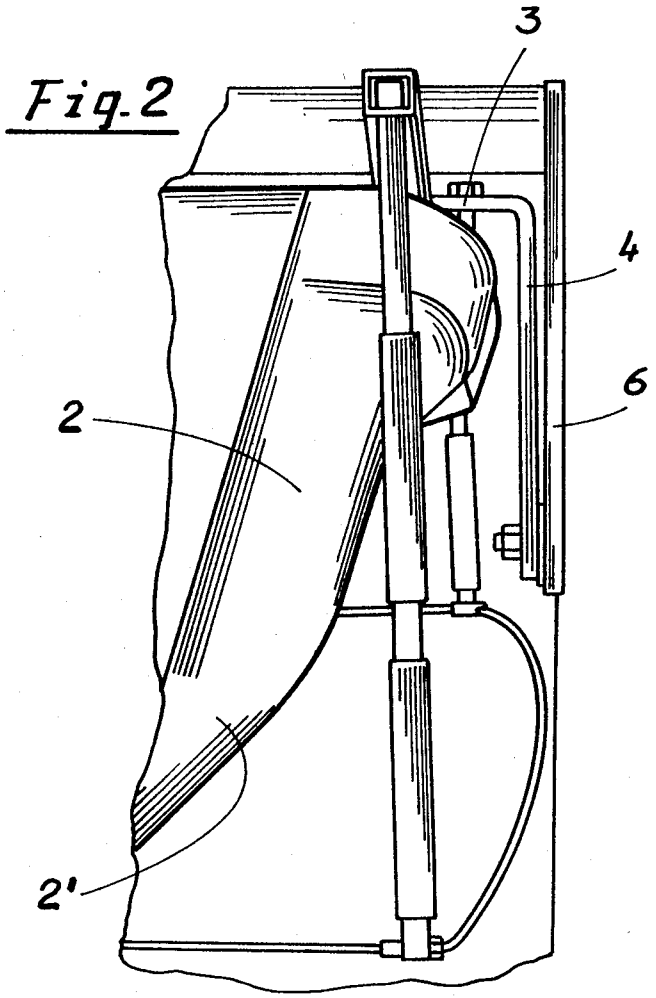
FIG. 2 illustrates the means for coupling the mentioned upper mold to the supporting structure therefor.
Figure 1:
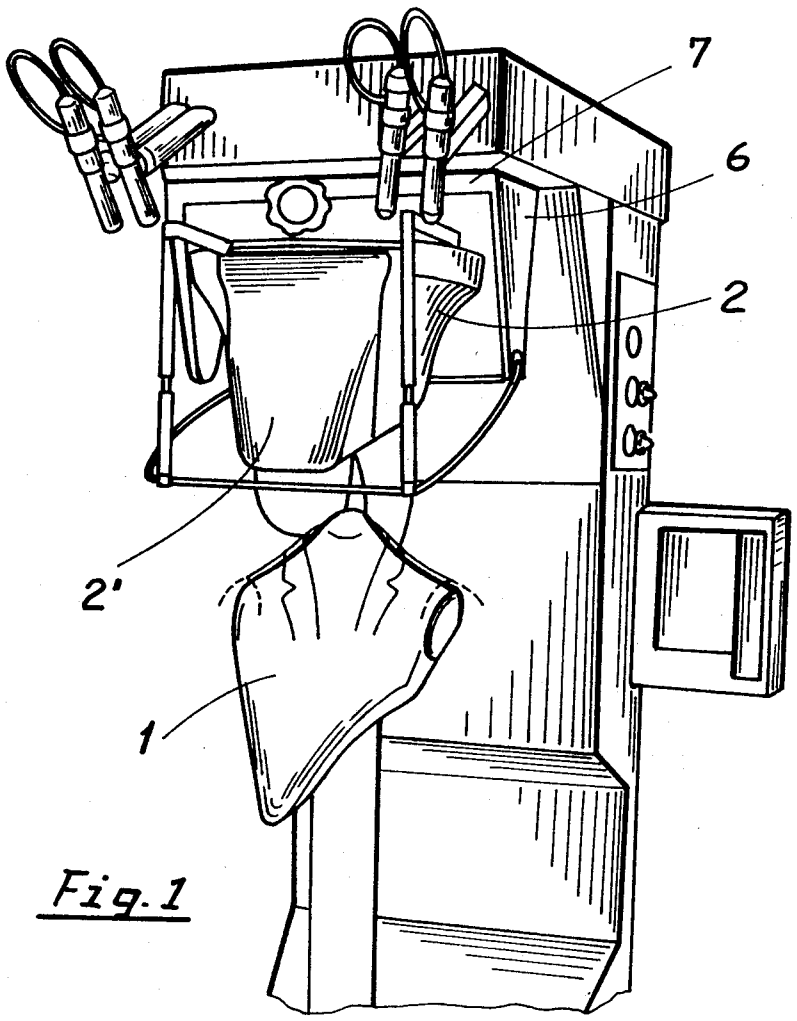
FIG. 1 is a schematic front perspective view of the subject ironing machine, with the upper mold thereof in its raised position.
Figure 3:
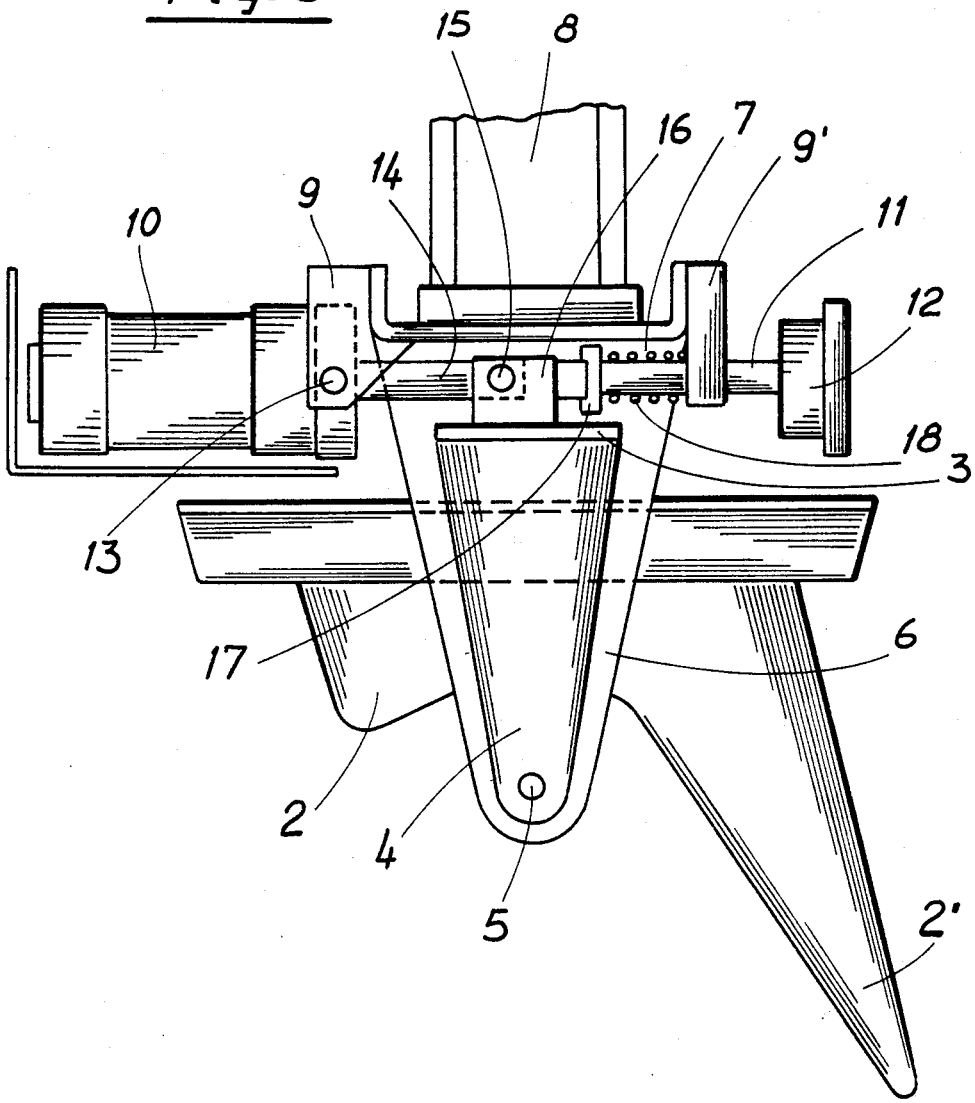
FIG. 3 is a side view illustrating the mentioned upper mold-supporting structure assembly.

With reference to the reference numbers of the figures of the accompanying drawings, a machine for ironing collars and cuffs or lapels according to the present invention comprises a fixed manikin or dummy 1, having a substantially conventional configuration corresponding to that of a part of the upper portion of a human body.

With that manikin 1 an upper or negative mold 2 cooperates, provided with a lug-shaped front portion 2' which extends downwardly. As visible in the drawings, the upper mold 2 has a configuration substantially matching the manikin 1 on the top and the front portion thereof.

That upper mold 2 is supported by a horizontal plate 3 provided, at the ends thereof, with downwardly extending arms 4 which at the bottom are coupled, through respective horizontal pins 5, with respective vertically extending arms 6 of a fork structure 7.

The fork structure 7, which thus defines means for pivotally supporting the upper mold 2 about a horizontal axis substantially parallel to the front portion of the manikin 1, is rigid with the piston rod or stem 8 of a double-acting fluid-operated cylinder, which extends vertically and is effective to vertically displace the upper or negative mold 2 with respect to the manikin 1 between a rest position in which the upper mold 2 is spaced from the manikin 1 and an operative position in which the upper mold 2 contacts the top portion of the manikin 1 and is suitably pressed against said manikin 1.

That same fork structure 7 is provided with two lateral shoulders 9 and 9', which respectively support a pneumatic cylinder 10 and receive a threaded rod 11, which latter is threaded into the respective shoulder 9' and provided with a control handwheel 12 at one end thereof.

The pneumatic cylinder 10 is pivoted, at 13, to the related shoulder 9 and has a piston rod or stem 14 pivoted, at 15, to a block 16, rigid with the mentioned horizontal plate 3 supporting the upper mold 2.

The threaded rod 11 is provided, at the end opposite to the handwheel 12, with an end abutment collar 17 for the piston rod 14 and for holding a biassing spring 18 between the collar itself and the shoulder 9'.

Accordingly, by operating the pneumatic cylinder 10, it is possible to pivot the upper mold 2 about its horizontal pivot axis defined by pins 5.

Figure 4:
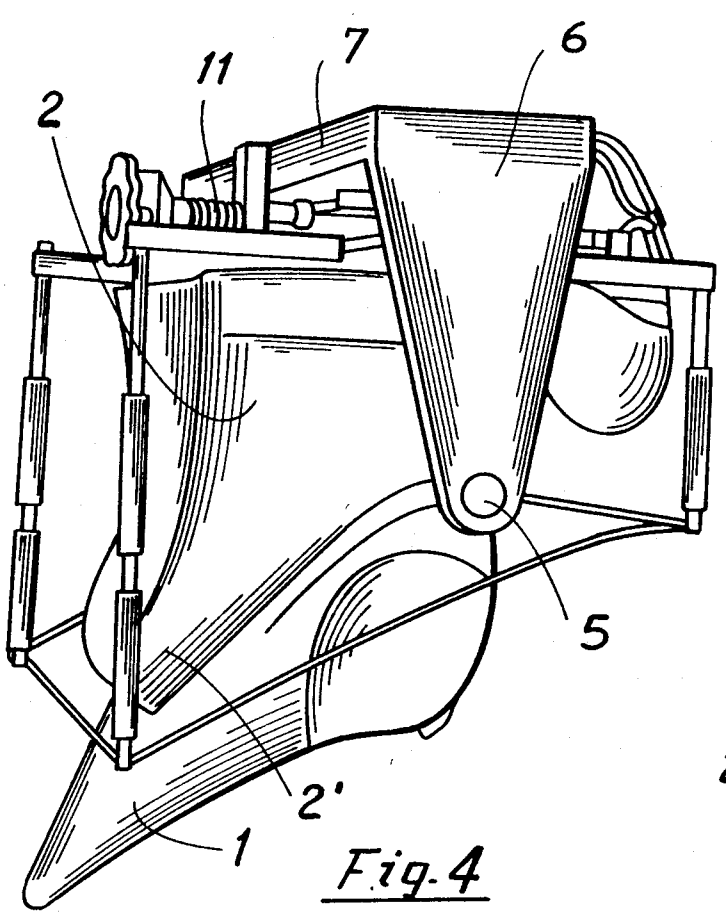

In actual practice the upper mold 2, as it is lowered onto the manikin 1, over which an article of clothing having a collar and lapels has been fitted, carries out the ironing of the collar of said article, see FIG. 4.

Figure 5:
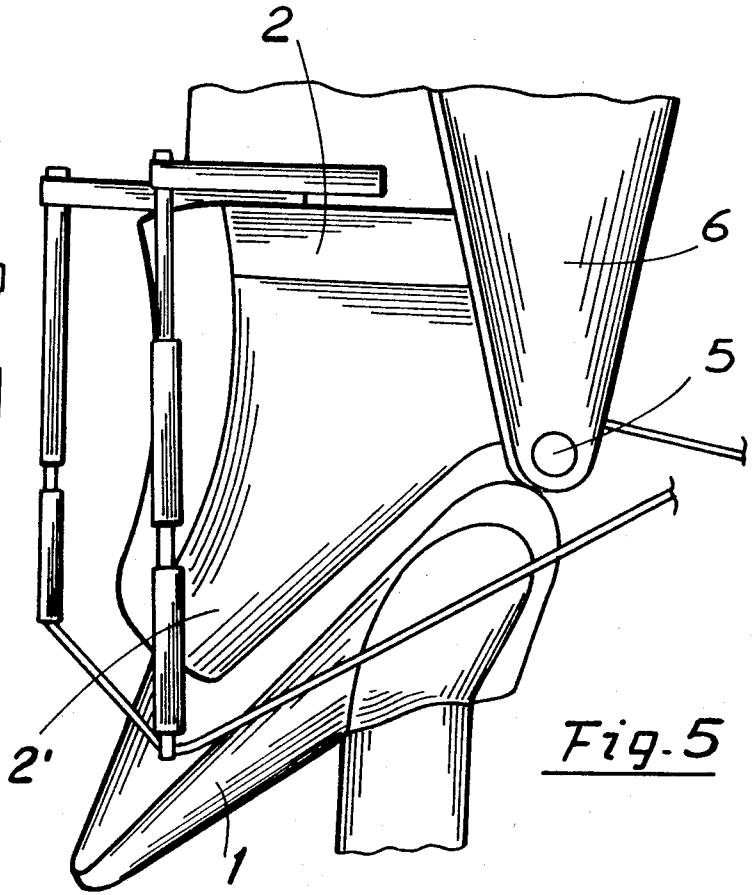
FIGS. 4, 5 and 6 illustrate the three mutual positions assumed by the upper or negative mold with respect to the manikin or taylor's dummy, during the ironing operation.

Then (FIG. 5), the upper mold 2 is raised, for a suitably limited stroke, from the manikin 1 into a position slightly spaced therefrom and is pivoted by the pneumatic cylinder 10 through a preset angle, thereby the lug-shaped portion 2' of the upper mold 2 assumes a position which is nearer to the vertical.

Figure 6:
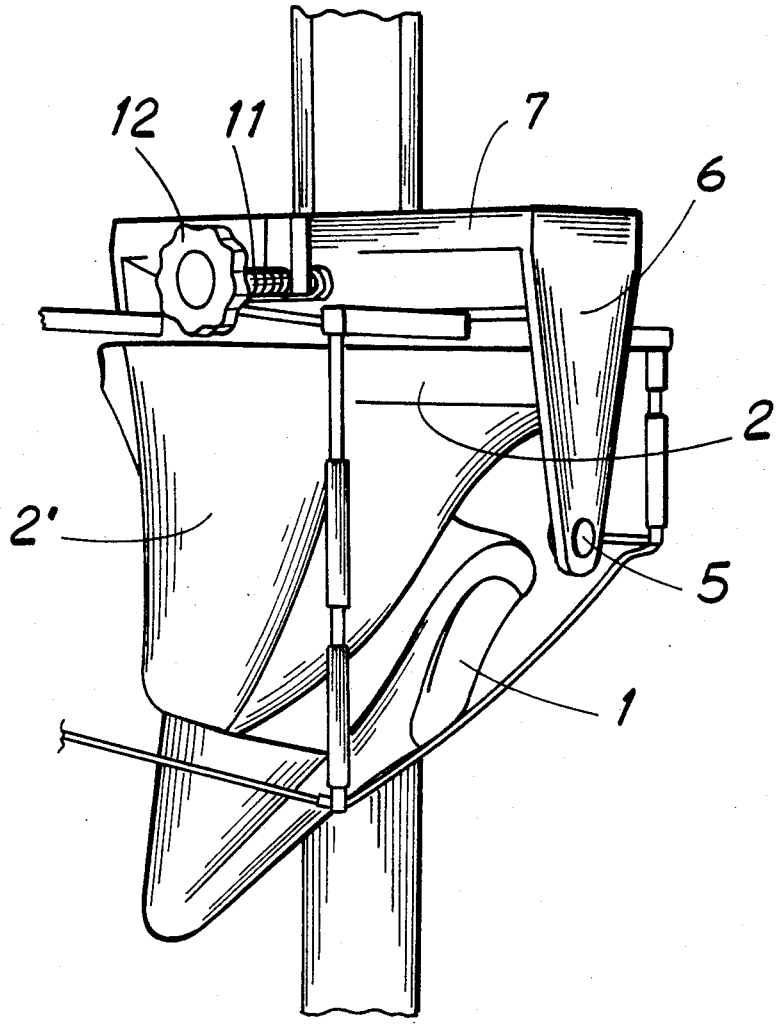

Then the upper mold 2 is brought again into contact with the manikin 1, thereby the portion 2', by pressing onto said manikin 1, carries out the ironing of the cuffs or lapels (FIG. 6).

More specifically, by loading suitably the biassing spring 18 by means of the handwheel 12, it will be possible to adjust the pressure imposed on the cuffs or lapels by the portion 2'.

It should also be pointed out that the horizontal pivoting axis of the upper mold 2, during the ironing operation, is located substantially at the level of the manikin shoulders.

Owing to that approach, the position assumed by the lug-shaped portion 2', after the pivoting step of the upper mold 2, will be such that the lug-shaped portion 2' will no longer press the lower ends of the cuffs or lapels.

From the above and from the observation of the figures of the accompanying drawings, the great functionality and use facility characterizing the machine for ironing collars and cuffs or lapels according to the present invention will be selfevident.

Obviously it will be clear that, while the subject invention has been hereinabove disclosed and illustrated with reference to an indicative embodiment thereof, it is susceptible to many modifications and variations falling within the scope of the invention.

I claim:

1. A machine for ironing collars and lapels on articles of clothing, comprising a fixed dummy having a configuration substantially corresponding to the configuration of a part of the upper portion of a human body for fitting an article of clothing having a collar and lapels, an upper mold having a lug-shaped downwardly extending portion and a configuration for substantially matching said dummy on a top and a front portion thereof, a support means for pivotally supporting said upper mold about a horizontal axis substantially parallel to said front portion, means for vertically displacing said support means between a rest position in which said upper mold is spaced from said dummy and an operative position in which said upper mold contacts said top portion of said dummy and is pressed against said top portion onto said collar, and means for selectively pivoting said upper mold about said horizontal axis and for pressing said lug-shaped portion against said front portion of said dummy onto said lapels when said upper mold as been brought into said operative position, wherein said upper mold is supported by a horizontal support plate having downwardly extending arms at opposite ends thereof, and wherein said support means comprises a fork structure having respective vertically extending arms pivotally supporting said downwardly extending arms, said fork structure being rigid with a piston of a vertically extending fluid-operated cylinder for vertically displacing said support means and said upper mold between said rest and operative positions.

2. A machine as claimed in claim 1, wherein said fork structure has two lateral shoulders, one of said lateral shoulders pivotally supporting a pneumatic cylinder having a piston rod pivoted to a block rigid with said support plate, the other of said lateral shoulders threadably receiving a threaded rod having a control handwheel at one end thereof and an abutment collar for said piston rod at another end thereof, a biassing spring being arranged between said abutment collar and said other shoulder.

3. A machine as claimed in claim 1, wherein said horizontal axis in said operative position is located substantially at the level of shoulders of said dummy.

* * * * *